US006234357B1

(12) United States Patent
Lewis

(10) Patent No.: US 6,234,357 B1
(45) Date of Patent: May 22, 2001

(54) MULTIPURPOSE CARRYING SYSTEM FOR DISPENSING VISCOUS LIQUID PRODUCTS

(75) Inventor: Richard P. Lewis, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/385,484

(22) Filed: Aug. 30, 1999

(51) Int. Cl.[7] ..... B67D 5/64

(52) U.S. Cl. ..... 222/175; 222/181.1; 222/212; 222/494

(58) Field of Search ..... 222/175, 181.1, 222/212, 213, 494; 224/148.2, 148.7

(56) References Cited

U.S. PATENT DOCUMENTS

| | | | | |
|---|---|---|---|---|
| D. 291,168 | | 8/1987 | Cranford . | |
| 899,290 | | 9/1908 | Bricker . | |
| 1,445,642 | * | 2/1923 | O'Neill | 224/148.7 |
| 1,611,275 | | 12/1926 | Lewis . | |
| 1,646,562 | | 10/1927 | Snow . | |
| 1,825,897 | * | 10/1931 | Brooke | 224/148.7 |
| 2,289,701 | | 7/1942 | Engel et al. . | |
| 2,532,244 | | 11/1950 | Pasmore . | |
| 2,550,554 | | 4/1951 | Griffin . | |
| 2,729,913 | | 1/1956 | Holwerda . | |
| 3,160,304 | | 12/1964 | Peacock . | |
| 4,228,928 | | 10/1980 | Hocker et al. . | |
| 4,363,432 | | 12/1982 | Warthen . | |
| 4,463,859 | | 8/1984 | Greene . | |
| 4,606,523 | | 8/1986 | Statz et al. . | |
| 4,708,273 | | 11/1987 | Grant . | |
| 5,056,696 | | 10/1991 | Lahr . | |
| 5,476,194 | | 12/1995 | Hippey et al. . | |
| 5,499,748 | * | 3/1996 | Iaia et al. | 222/213 |
| 5,971,232 | * | 10/1999 | Rohr et al. | 222/213 |
| 5,984,557 | | 11/1999 | Fennell . | |
| 6,062,435 | * | 5/2000 | Hess, III | 222/175 |

OTHER PUBLICATIONS

International Search Report dated Jan. 23, 2001.

* cited by examiner

*Primary Examiner*—Joseph A. Kaufman
(74) *Attorney, Agent, or Firm*—Dority & Manning

(57) ABSTRACT

A dispenser arrangement allows various cleansing or sanitizing products to be carried on the body of a user, or mounted at other convenient locations. The dispenser arrangement includes a product container, and a holster device adapted to carry the product container. Typically, the product container will be carried in the holster device in an inverted orientation. The holster device includes mounting structure, such as a mounting clip, which attaches to the clothing of a user. An adapter element may be provided so that the holster device can be mounted, via the mounting structure, to a stationary surface. Preferably, the holster device is specially configured so that only a small portion of the product container's outer surface is obstructed. Often, the product to be dispensed will be a viscous liquid, such as soap, waterless hand cleaner, waterless hand sanitizer or skin lotion. A dispensing pressure applied to the flexible sidewall of the product container causes the viscous liquid to be dispensed.

22 Claims, 5 Drawing Sheets

MULTIPURPOSE CARRYING SYSTEM FOR DISPENSING VISCOUS LIQUID PRODUCTS

BACKGROUND OF THE INVENTION

The present invention relates generally to dispensers which contain and dispense a predetermined viscous liquid. More particularly, the invention relates to an arrangement that permits a viscous liquid container to be mounted in various desirable locations, including the body of an individual user.

Many professions and occupations require the use of hand cleaners or other skin care products on a frequent basis. For example, health care providers such as nurses must sanitize their hands after each patient. Often, the nurse must return to the nurses' station to perform this hand sanitizing, which can cause additional time pressure in an already busy schedule.

Similarly, the hands of an employee working in a printing, manufacturing or other such industry can become soiled at the work station. Frequent trips to the washroom for the purpose of hand cleaning are inefficient and unproductive. In other situations, such as in the case of a utility or similar outside worker, there may be no washroom facility available if the worker's hands become soiled.

In other situations, it may be desirable to mount a viscous liquid container at various convenient locations. For example, a viscous liquid container could be mounted on a medical cart, or near a workstation in an industrial environment. Such an arrangement would permit the worker to use the viscous liquid without the need to walk to a nurses station, washroom or the like.

SUMMARY OF THE INVENTION

The present invention recognizes and addresses the foregoing disadvantages, and others, of the prior art. Accordingly, it is an object of the present invention to provide a novel product dispenser arrangement.

It is a further object of the present invention to provide a product dispenser arrangement having a multipurpose carrying device.

It is a further object of the present invention to provide a product dispenser arrangement that allows viscous liquid to be dispensed without removing the product container from the carrying device.

It is a more particular object of the present invention to provide a product dispenser arrangement that is wearable on the body of a user.

It is a more particular object of the present invention to provide a product dispenser arrangement that is mountable to a surface.

Some of these objects are achieved by a dispenser arrangement for dispensing viscous liquid comprising a product container having therein a quantity of a predetermined viscous liquid. The product container has a container opening located at one end thereof. The product container further includes a flexible sidewall such that depression of the flexible sidewall will cause the viscous liquid to be forced through the container opening. A holster device is adapted to support the product container in an inverted orientation. The holster device has mounting means located at an upper portion thereof.

In exemplary embodiments, the holster device comprises a lower support element having a fully circumferential structure and an upright element extending up from the lower support element. Often, the mounting means may comprise a mounting clip formed as an integral extension of the upright element. Alternatively, a mounting clip may include a clip portion pivotally connected to the upright element.

In some cases, the dispenser arrangement further includes an adapter element mountable to a surface. The adapter element is configured to mate with the mounting means and thereby retain the holster device.

Preferably, the holster device may further comprise a stabilizing element spaced apart from the lower support element. For example, the stabilizing element may comprise a pair of arcuate arms extending laterally out from the upright element. When the product container has a flattened cross section, the arcuate arms will have a similar shape.

Often, an outer surface of the product container and an inner surface of the lower support element may define generally complementary tapers to inhibit the product container from passing through the lower support element. A bottom edge of the lower support element may define a configured recess to facilitate access to the product container for opening and closing of the container opening. The container opening itself may include a normally-closed valve, the valve being opened when the flexible sidewall is depressed.

Other objects of the present invention are achieved by a dispenser arrangement comprising a product container and a holster device adapted to support the product container. The holster device includes an upright element and a lower support element, located at a lower portion of the upright element and having a fully circumferential structure. The holster device further includes a mounting clip located at an upper portion of the upright element. A pair of arcuate arms extend laterally out from the upright element at an intermediate location thereof. Often, the holster device may be formed as a unitary piece of a predetermined plastic material, and may be advantageously formed of clear plastic material.

Other objects, features and aspects of the present invention are achieved by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
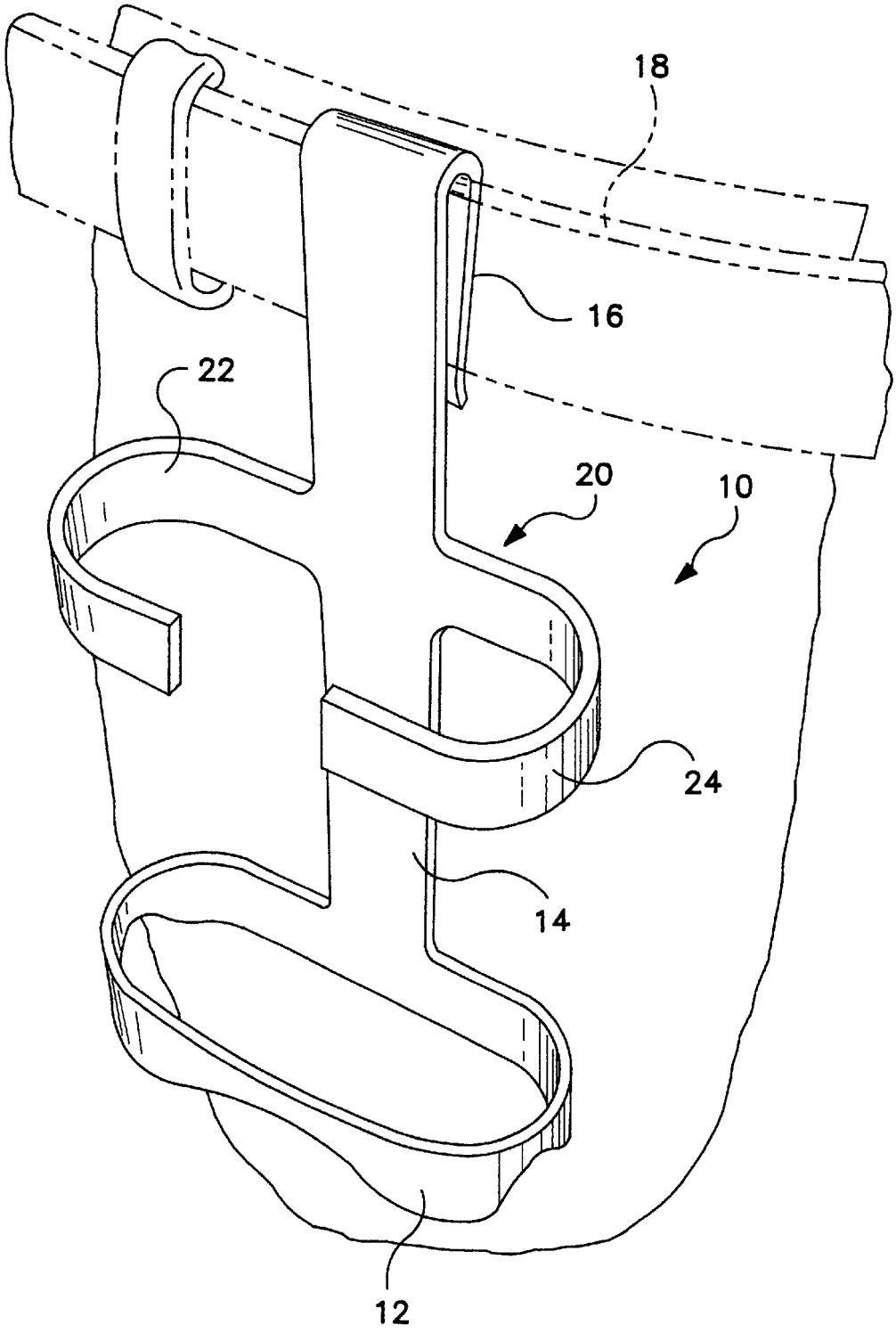
FIG. 1 is a perspective view of a holster device for supporting a product container, the holster device being attached to the belt of a user.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

FIG. 1 illustrates a holster device 10 adapted to support a container for viscous liquid or other consumable product. In many embodiments, holster device 10 may be formed as a unitary body made from an appropriate plastic material. For example, a clear plastic material will often be desirable, so that a user will be permitted to read the label of the product container even when it is partially covered by a portion of the holster device.

Figure 2:
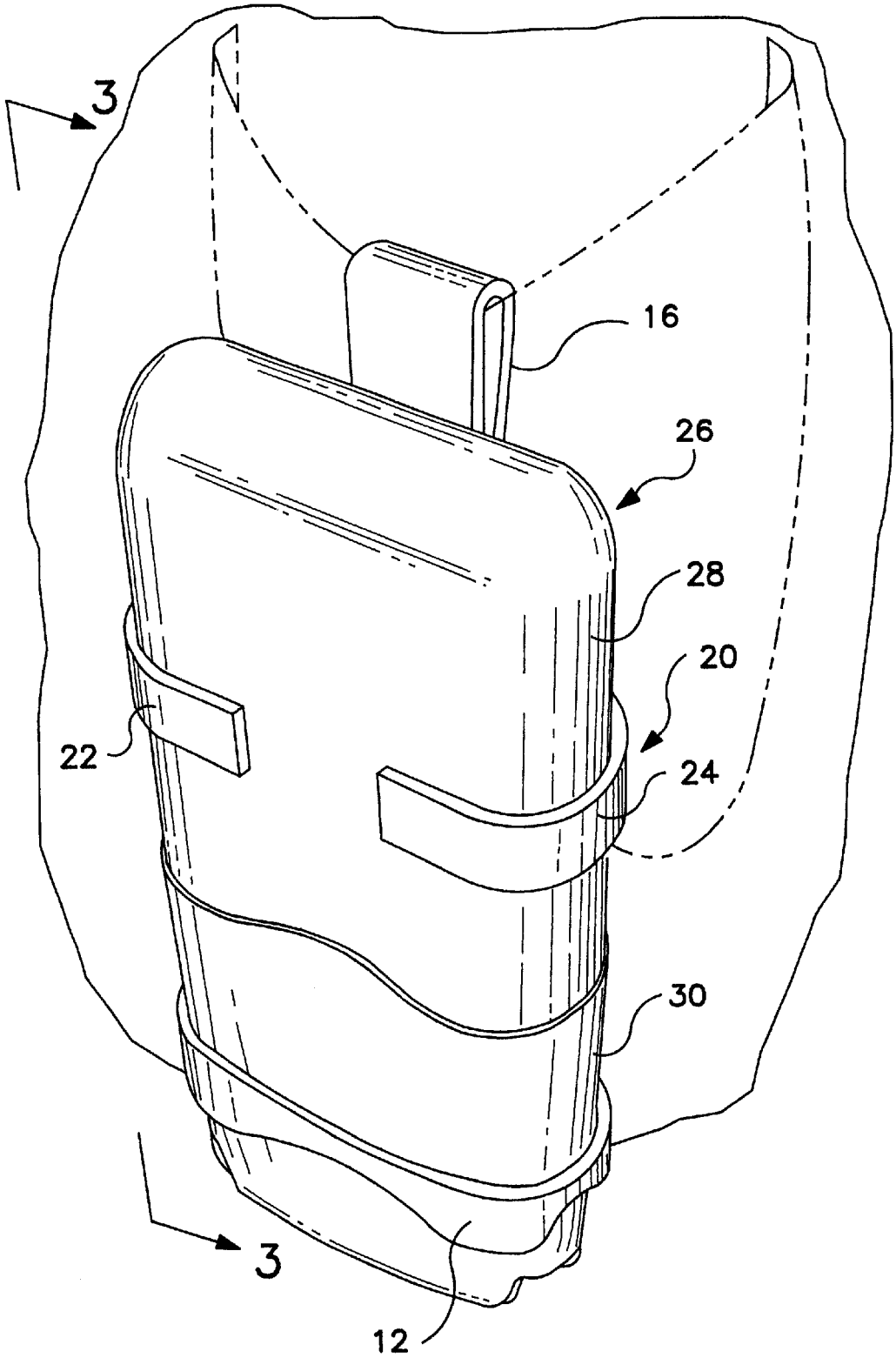
FIG. 2 is a perspective view of the holster device of FIG. 1 with a product container being supported therein, the holster device being attached to the pocket of a user.

Holster device 10 includes a lower support element 12 having a fully circumferential extent. An upright element 14 integrally extends from lower support element 12, as shown. Suitable mounting means, here mounting clip 16, are located at the upper portion of upright element 14 so that holster device 10 can be mounted in a variety of desirable locations. For example, clip 14 permits holster device 10 to be worn on the user's body, such as on the user's belt 18. Of course, mounting clip 16 is not limited to mounting on the belt of a wearer, but can also be mounted at any other suitable location, e.g., the user's pocket (FIG. 2). Clip 16 is formed as an integral extension of upright element 14 in this embodiment.

Holster device 10 further includes a stabilizing element 20 spaced apart from lower support element 12. While lower support element 12 primarily serves to support the weight of the product container, stabilizing element 20 prevents the product container from tipping. Here, stabilizing element 20 comprises a pair of arcuate arms 22 and 24 extending laterally out from upright element 14, as shown.

Referring now to FIG. 2, holster device 10 is shown equipped with a product container 26. In this case, the body of product container 26 includes a main container portion 28 and a cap portion 30. A quantity of a predetermined viscous liquid is located inside of main container portion 28 to be dispensed by a user when desired. Depending on the user's requirements, the viscous liquid may be one of several different types of cleansing or skin care products. For example, the viscous liquid may be soap, waterless hand cleaner, waterless hand sanitizer, skin lotion, or the like.

In this embodiment, product container 26 is inverted when holster device 10 is worn. In other words, the "top end" of product container 26, defined by cap portion 30, will be directed toward the floor. As a result, the user will typically be able to dispense the viscous liquid into a cupped hand without first removing the product container from holster device 10.

Figure 3:
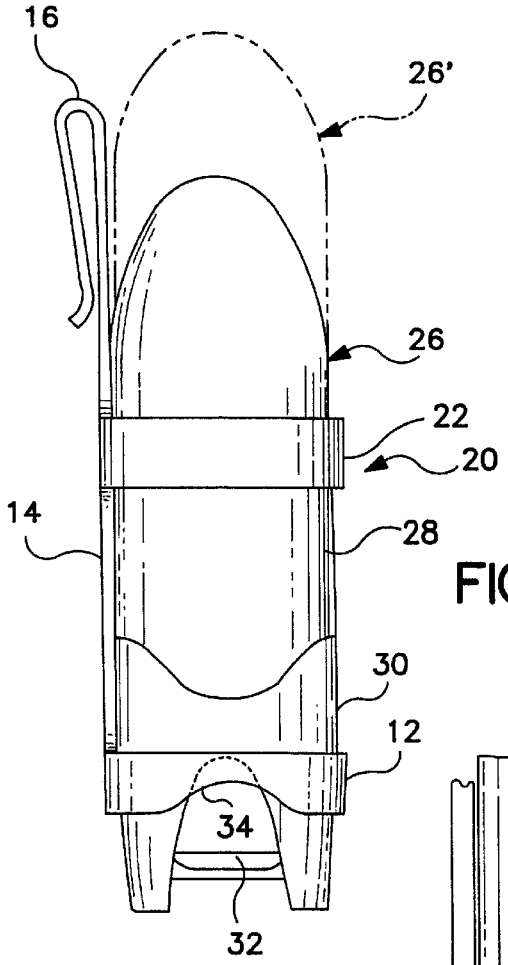
FIG. 3 is a side elevation taken along line 3—3 of FIG. 2.

Depending on the product, or the requirements of a particular application, it may be desirable to use product containers of different types or sizes. For example, a product container for dispensing fabric cleaning wipes may be adapted for receipt in holster device 10. (Typically, a fabric wipe dispenser will be used in an upright orientation.) FIG. 3, on the other hand, shows a product container 26', which is larger than product container 26 but is otherwise similar. In fact, the user may substitute one product container for the other while keeping holster device 10 in position on the user's body. Thus, a common holster device can be used with multiple product containers.

Irrespective of the size or orientation, the product containers are preferably configured having a flattened cross section so that they do not excessively protrude from the side of the user's body. For example, product container 26 has a generally oval cross section in the illustrated embodiment.

As can be clearly seen in FIG. 3, lower support element 12 has a relatively narrow vertical width so as not to restrict access to and the application of dispensing pressure to the side walls of the product container. In addition, stabilizing element 20 preferably surrounds the product container only partially. This allows further access to the sidewall of the product container for application of dispensing pressure.

Figure 3A:
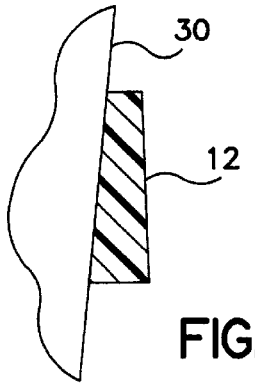
FIG. 3A is an enlarged fragmentary view showing the internal taper of the lower support element and complementary external taper of the product container.

Referring to FIG. 3A, the inside surface of lower support element 12 preferably defines a taper on its inside surface that is generally complementary to a taper defined by the outside surface of cap portion 30. As a result, product container 26 will be seated, supported and retained by holster device 10.

In the illustrated embodiment, the product container is fully closed when a lever member 32, pivotally carried by cap portion 30, is located in the closed position shown in FIG. 3. Thus, the user must move lever member 32 to an open position before viscous liquid can be dispensed. Preferably, lower support element 12 defines one or more configured recesses 34 to facilitate access to lever member 32.

Figure 4A:
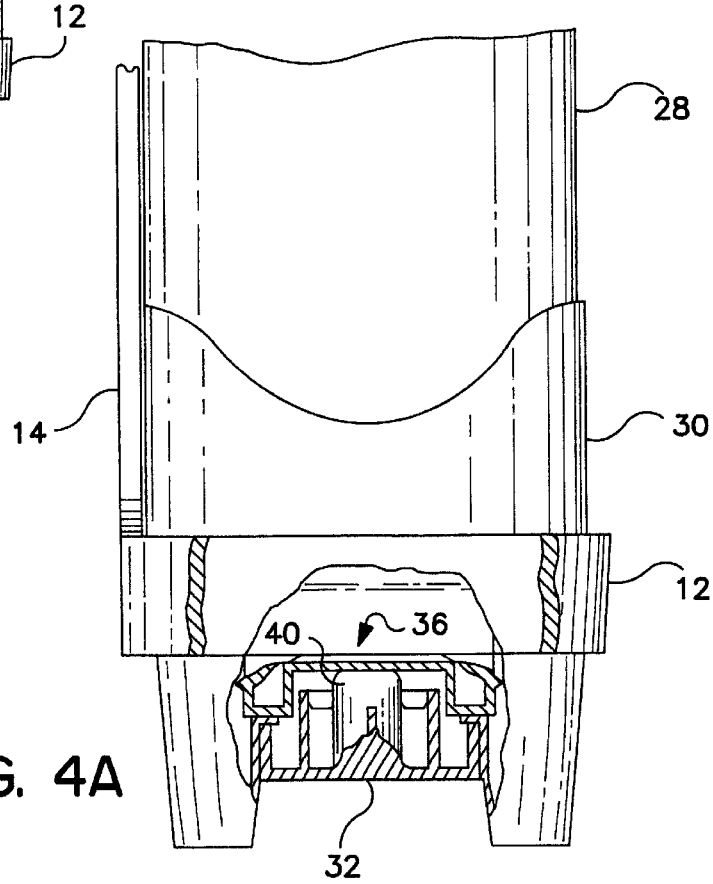
FIGS. 4A and 4B are enlarged fragmentary views, partially in section, showing the structure and operation of a normally-closed valve located at the container opening in the product container of FIGS. 2 and 3.
Figure 4B:
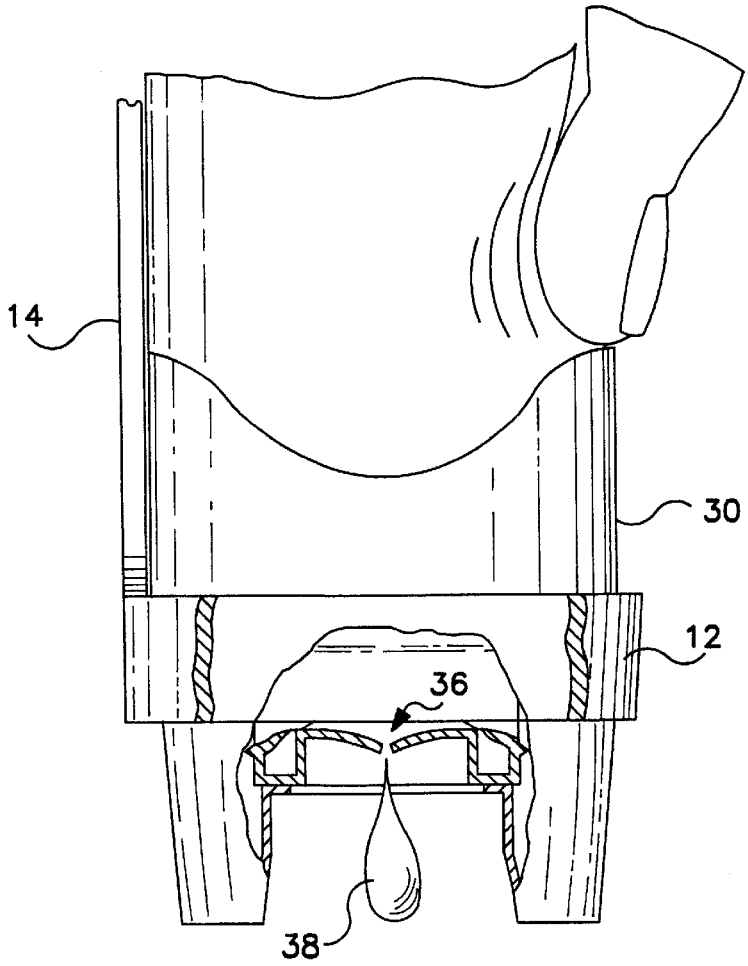

Referring now to FIGS. 4A and 4B, product container 26 is preferably equipped with a valve mechanism which eliminates the need to repeatedly open and close lever member 32 each time that a user decides to dispense some of the viscous liquid. Valve 36 remains normally closed to retain the viscous liquid inside of the product container even though the lever member 32 is otherwise opened. When the flexible sidewall of main container portion 28 is depressed by a user, a "shot" of the viscous liquid is dispensed (as shown in FIG. 4B).

While various types of check valves and the like may be used for this purpose, valve 36 is preferably formed as a simple diaphragm valve directly at the container opening. The diaphragm valve operates similarly to a heart valve, opening when fluid is pushed through it from behind, then resuming its normally closed condition.

As shown in FIG. 4A, lever member 32 preferably includes a stopper element 40 that will engage valve 36 when lever member 32 is in its closed position. Stopper element 40 will thus block the container opening, and prevent the viscous liquid from being dispensed.

While an integral mounting clip has been described above, it should be appreciated that various other suitable mounting means may also be used within the scope of the present invention. In some embodiments, for example, it may be desirable to utilize a belt-loop structure for the mounting means. In addition, a suitable mounting clip can take on a number of different configurations.

Figure 5:
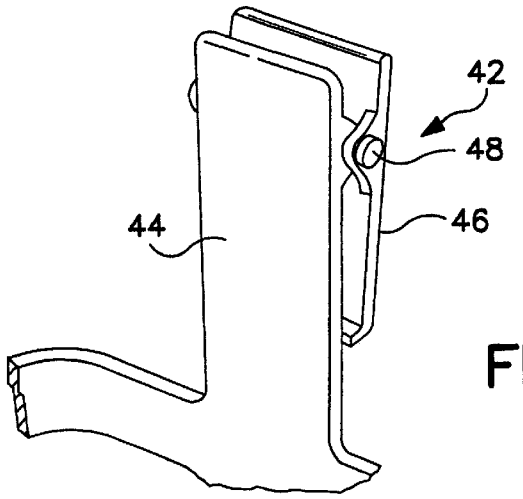
FIG. 5 is a fragmentary view of an upper portion of a modified holster device constructed in accordance with the present invention, showing an alternative arrangement for the mounting clip.

Toward this end, FIG. 5 illustrates an alternative mounting clip 42 provided at the upper portion of a modified upright element 44. As shown, mounting clip 42 includes a rigid clip portion 46 connected to upright element 44 such that it will pivot about pivot location 48. A suitable spring may be provided to urge clip portion 46 into a normally closed position.

Figure 6:
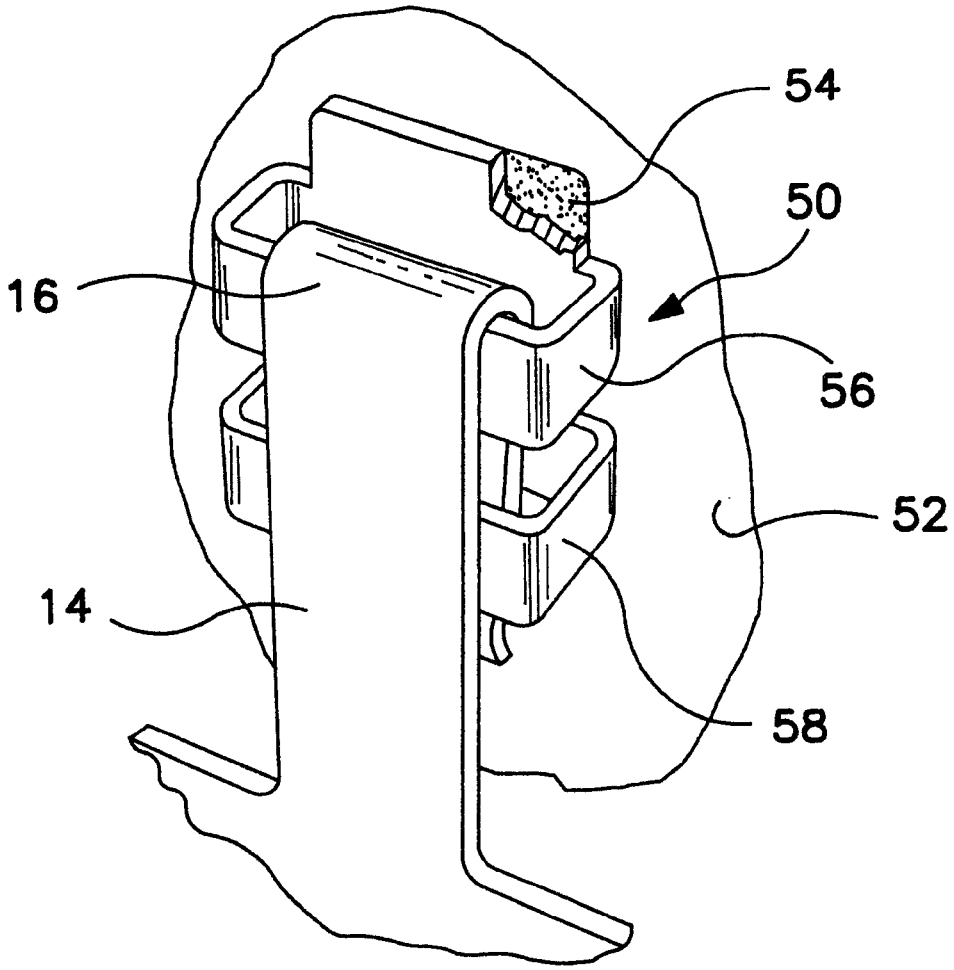
FIG. 6 is a perspective view of an adapter element that may be utilized to mount the holster device to a wall or other surface.

Often, it will be desirable to mount holster device 10 somewhere other than the body of a user. In many cases, for example, it may be advantageous to mount holster device 10 on a medical cart, a wall in a patient's room, or near a work station in an industrial environment. In this regard, FIG. 6 illustrates an adapter element 50 mounted to a fixed surface 52. In this case, adapter element 50 is fixed to surface 52 using a double-sided tape 54. One skilled in the art will appreciate, however, that other suitable attachment means, such as screws, suction cups or other means, may also be utilized to attach adapter element 50.

Adapter element 50 is configured to mate with the particular mounting means of the holster device. In the illustrated embodiment, for example, holster device 10 is equipped with mounting clip 16. Thus, adapter element 50 includes suitable means, here formed by a pair of loops 56 and 58, to receive mounting clip 16. As a result, holster device 10 will hang on the fixed surface, as desired.

It can thus be seen that the present invention provides a product dispenser arrangement having a multipurpose carrying device for a product container. While preferred embodiments of the invention have been shown and described, modifications and variations may be made thereto by those of ordinary skill in the art without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A dispenser arrangement for dispensing viscous liquid, said dispenser arrangement comprising:

a product container having therein a quantity of a predetermined viscous liquid, said product container including a container opening located at one end thereof;

said product container further including a flexible sidewall such that depression of said flexible sidewall will cause said viscous liquid to be forced through said container opening; and a holster device adapted to support said product container in an inverted orientation, said holster device having mounting means located at an upper portion thereof, said holster device comprising a lower support element having a closed circumferential structure; and wherein an outer surface of said product container and an inner surface of said lower support element define generally complementary tapers to inhibit said product container from passing through said lower support element.

2. A dispenser arrangement as set forth in claim 1, wherein said holster device further comprising an upright element extending up from said lower support element.

3. A dispenser arrangement as set forth in claim 2, wherein said mounting means comprises a mounting clip.

4. A dispenser arrangement as set forth in claim 3, wherein said mounting clip is formed as an integral extension of said upright element.

5. A dispenser arrangement as set forth in claim 3, wherein said mounting clip includes a clip portion pivotally connected to said upright element.

6. A dispenser arrangement as set forth in claim 1, further comprising an adapter element mountable to a surface, said adapter element being configured to mate with said mounting means and thereby retain said holster device.

7. A dispenser arrangement as set forth in claim 2, wherein said holster device further comprises a stabilizing element spaced apart from said lower support element.

8. A dispenser arrangement as set forth in claim 7, wherein said stabilizing element comprises a pair of arcuate arms extending laterally out from said upright element.

9. A dispenser arrangement as set forth in claim 2, wherein the height of said circumferential structure is greater in length than the thickness of said circumferential structure.

10. A dispenser arrangement as set forth in claim 2, wherein a bottom edge of said lower support element defines a configured recess to facilitate access to said product container for opening and closing of said container opening.

11. A dispenser arrangement as set forth in claim 1, wherein said viscous liquid is selected from a group consisting of soap, waterless hand cleaners, waterless hand sanitizers and skin lotion.

12. A dispenser arrangement as set forth in claim 1, wherein said container opening includes a normally-closed valve, said valve being opened when said flexible sidewall is depressed.

13. A dispenser arrangement as set forth in claim 1, wherein said product container is configured having a flattened cross section.

14. A dispenser arrangement comprising:

a product container; and a holster device adapted to support the product container, said holster device including:

(a) an upright element;

(b) a lower support element having a fully circumferential structure located at a lower portion of said upright element, an outer surface of said product container and an inner surface of said lower support element define generally complementary tapers to inhibit said product container from passing through said lower support element;

(c) a mounting clip located at an upper portion of said upright element; and (d) a pair of arcuate arms extending laterally out from said upright element at an intermediate location thereof.

15. A dispenser arrangement as set forth in claim 14, wherein said holster device is formed as a unitary piece of a predetermined plastic material.

16. A dispenser arrangement as set forth in claim 15, wherein said holster device is formed of clear plastic material.

17. A dispenser arrangement as set forth in claim 14, wherein said mounting clip is formed as an integral extension of said upright element.

18. A dispenser arrangement as set forth in claim 14, wherein said mounting clip includes a clip portion pivotally connected to a base portion on said upright element.

19. A dispenser arrangement as set forth in claim 14, further comprising an adapter element mountable to a surface, said adapter element being configured to receive said mounting clip and thereby retain said holster device.

20. A dispenser arrangement as set forth in claim 14, wherein a bottom edge of said lower support element defines a configured recess to facilitate access to said product container for opening and closing of said container opening.

21. A dispenser arrangement as set forth in claim 14, wherein said viscous liquid is selected from a group consisting of soap, waterless hand cleaners, waterless hand sanitizers and skin lotion.

22. A dispenser arrangement as set forth in claim 14, wherein said product container is configured having a flattened cross section.

* * * * *